US006908895B2

(12) United States Patent
Bakker et al.

(10) Patent No.: US 6,908,895 B2
(45) Date of Patent: Jun. 21, 2005

(54) PARTICULATE LAUNDRY DETERGENT COMPOSITION CONTAINING ZEOLITE

(75) Inventors: Vera Johanna Bakker, Warrington (GB); Arie Krijgsman, Vlaardingen (NL); Edwin Leo Lempers, Vlaardingen (NL); Jasper Mol, Vlaardingen (NL)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 407 days.

(21) Appl. No.: 10/145,055

(22) Filed: May 14, 2002

(65) Prior Publication Data

US 2002/0198134 A1 Dec. 26, 2002

(30) Foreign Application Priority Data

May 16, 2001 (GB) ..... 0115552

(51) Int. Cl.[7] ..... C11D 3/08; C11D 1/83

(52) U.S. Cl. ..... 510/444; 510/276; 510/443; 510/426; 510/428; 510/452; 510/507; 510/532; 510/477; 510/445

(58) Field of Search ..... 510/276, 443, 510/444, 426, 428, 452, 507, 532, 477, 445

(56) References Cited

U.S. PATENT DOCUMENTS

| | | | | | |
|---|---|---|---|---|---|
| 4,203,851 | A | * | 5/1980 | Ramachandran | 510/101 |
| 4,869,843 | A | | 9/1989 | Saito et al. | 252/135 |
| 5,205,958 | A | * | 4/1993 | Swatling et al. | 510/444 |
| 5,540,855 | A | * | 7/1996 | Baillely et al. | 510/276 |
| 5,569,645 | A | | 10/1996 | Dinniwell et al. | 510/276 |
| 5,583,098 | A | * | 12/1996 | Boskamp et al. | 510/351 |
| 6,008,178 | A | * | 12/1999 | Baillely et al. | 510/392 |
| 6,046,149 | A | * | 4/2000 | Sorrie et al. | 510/320 |
| 6,069,124 | A | | 5/2000 | Appel et al. | 510/438 |
| 6,093,218 | A | * | 7/2000 | Hall et al. | 8/137 |
| 6,133,227 | A | * | 10/2000 | Barnabas et al. | 510/530 |

FOREIGN PATENT DOCUMENTS

| | | |
|---|---|---|
| DE | 195 24 722 | 1/1997 |
| EP | 219 328 | 4/1987 |
| EP | 342 043 | 11/1989 |
| EP | 534 525 | 3/1993 |
| GB | 1 371 101 | 10/1974 |
| JP | 03/084100 | 4/1991 |
| WO | 92/18596 | 10/1992 |
| WO | 96/34084 | 10/1996 |
| WO | 97/43366 | 11/1997 |
| WO | 98/04661 | 2/1998 |
| WO | 98/04662 | 2/1998 |
| WO | 98/04668 | 2/1998 |
| WO | 98/54278 | 12/1998 |
| WO | 98/54287 | 12/1998 |
| WO | 98/54288 | 12/1998 |
| WO | 98/55574 | 12/1998 |
| WO | 00/42162 | 7/2000 |
| WO | 00/77141 | 12/2000 |
| WO | 00/78915 | * 12/2000 |

OTHER PUBLICATIONS

PCT International Search Report in a PCT application, PCT/EP 02/05096.

Co–pending application: Applicant: Bakker et al., U.S. Appl. No. 09/805,263; Filed: Mar. 13, 2001.

Co–pending application: Applicant: Berthod et al., U.S. Appl. No. 09/590,313; Filed: Jun. 8, 2000.

GB Search Report in a GB application GB 0006037.6.

Derwent Abstract of WO 98/55574.

Derwent Abstract of WO 00/42162—published Jul. 20, 2000.

PCT International Search Report in a PCT application PCT/EP 01/02142.

* cited by examiner

*Primary Examiner*—Charles Boyer
(74) *Attorney, Agent, or Firm*—Rimma Mitelman

(57) ABSTRACT

A particulate zeolite-built laundry detergent composition having a bulk density of at least 550 g/l comprising at least two different granular components containing both surfactant and builder, preferably one prepared by non-tower granulation and another spray-dried, also contains from 1 to 10 wt % citric acid admixed as a separate particulate component. The admixed citric acid improves dispensing and dissolution properties, whether or not separately admixed sodium carbonate is present.

11 Claims, No Drawings

PARTICULATE LAUNDRY DETERGENT COMPOSITION CONTAINING ZEOLITE

TECHNICAL FIELD

The present invention relates to particulate laundry detergent compositions of containing zeolite builder and citric acid. More particularly the invention relates to zeolite-built compositions having moderate to high bulk densities, for example, within the range of from 600 to 900 g/l.

BACKGROUND AND PRIOR ART

Particulate laundry detergent compositions of reduced or zero phosphate content containing zeolite builder are now well known and widely available.

Detergent powders normally consist of a principal homogeneous granular component, normally referred to as the base powder, containing at least organic surfactant and inorganic builder, and generally containing other robust ingredients. This may be prepared by spray-drying or by a non-tower mixing and granulation method.

Recently detergent powders containing more than one surfactant-containing ingredient (base granule) have been proposed. In particular, the art discloses powders containing a dense base granule prepared by a non-tower (non-spray-drying) mixing and granulation process, and a second base granule of lower bulk density prepared by spray-drying. The use of two different base granules enables a range of products having different bulk densities and/or different compositions to be prepared to suit differing customer needs and habits.

It has been found that compositions of this type may suffer from dispensing problems when used in European-type front-loading automatic washing machines. While dispensing devices can be used, many customers prefer to use the machine dispenser drawer and there is a demand for zeolite-built powders of all bulk densities that will dispense as well as the traditional spray-dried phosphate-built powders.

The present inventors have now discovered that dispensing of two-base or multi-base powders may be significantly improved by the inclusion of citric acid as a separate, admixed ingredient. This benefit is observed whether or not sodium carbonate is present as a separate, admixed ingredient.

PRIOR ART

EP 534 525B (Unilever) discloses a granular detergent composition of high bulk density (650 to 1100 g/l) comprising anionic and/or nonionic surfactants, sodium carbonate (and/or bicarbonate and/or sesquicarbonate), other builder material, and 1 to 15 wt % of particulate citric acid having a defined particle size, as a separate granular ingredient.

WO 92 18596A/EP 581 857B (Procter & Gamble) discloses a laundry detergent powder containing surfactant (5–70 wt %), postdosed sodium carbonate (5–75 wt %), and postdosed citric acid (up to 15 wt %), the ratio of postdosed carbonate to postdosed citric acid being 2:1–15:1. The claimed benefit is improved solubility in the wash and reduced residues on the washload, as a result of the effervescence-generating reaction between between the postdosed citric acid and the postdosed carbonate.

WO 98 55574A/EP 986 629A (Henkel) discloses the use of organic acids in essentially bleach free detergent compositions to improve bleachable stain removal. Also disclosed is an essentially bleach-free granular detergent composition of bulk density 650–1100 g/l, containing anionic and/or nonionic surfactants and builders, including 1–15 wt % of a separate or subsequently added organic acid. The preferred organic acid is citric acid.

WO 97 43366A/EP 906 385A (Procter & Gamble) discloses a detergent composition containing anionic surfactant (0.5–60 wt %), cationic surfactant (0.01–30 wt %), and also containing an acid source (preferably citric acid) and an alkali source (preferably carbonate, bicarbonate, sesquicarbonate, percarbonate) capable of reacting together in the presence of water to generate a gas. Neither acid source nor alkali source need be admixed as a separate granule.

WO 98 04661A/EP 915 949A (Procter & Gamble) discloses a detergent composition comprising a surfactant, at least 15% by weight of a sulphate salt, and an acid dispersing aid (e.g. citric acid) and an alkali source (e.g. sodium carbonate) capable of reacting together in the presence of water to generate a gas, the weight ratio of sulphate to (citric) acid being 13.5:1 or less.

WO 98 04662A/EP 915 950A (Procter & Gamble) discloses a laundry detergent composition containing a surfactant and and a system which liberates gas on reaction, comprising a particulate acid source (e.g. citric acid, glutaric acid, adipic acid) of which ≧80% has a particle size of 150–710 micrometers, and an alkali source (e.g. sodium carbonate, bicarbonate, sesquicarbonate, percarbonate).

WO 98 04668A/EP 915 956A (Procter & Gamble) discloses a bleaching detergent composition containing at least 13 wt % of a perborate bleach component, a tri- or multi-protonic acid source (e.g. citric acid) and an alkali source, the acid source and the alkali source being capable of reacting together in the presence of water to generate a gas.

WO 98 54288A (Unilever) discloses a particulate laundry detergent composition having a bulk density of at least 550 g/l, comprising a non-tower base powder and a spray-dried adjunct, wherein the non-tower base powder constitutes from 35 to 85 wt % of the total composition.

WO 96 34084A (Procter & Gamble/Dinniwell) discloses a low-dosage, highly dense detergent powder comprising about 40 to 80% by weight of spray-dried detergent granules, about 20 to 60% by weight of dense detergent agglomerates, and about 1 to 20% by weight of postdosed ingredients.

JP 03 084 100A (Lion) discloses a high bulk density detergent powder prepared by mixing spray-dried detergent particles, containing 20 to 50% by weight of anionic surfactant and 10 to 70% by weight of zeolite, with 1 to 15% by weight of separately prepared high bulk density detergent granules.

WO 00/77141A (Unilever) discloses a zeolite-built detergent powder of bulk density 600 to 900 g/l containing non-tower base granule containing zeolite MAP, and spray-dried base granules containing zeolite A.

Our copending unpublished International Patent Application No. PCT/EP01/02142 filed on 26, Feb. 2001 discloses laundry detergent powders containing at least two different multi-ingredient granular components, for example, a high bulk density non-spray-dried base granule containing surfactant and zeolite builder, and a lower bulk density spray-dried base granule containing surfactant and zeolite builder.

DEFINITION OF THE INVENTION

The present invention provides a particulate laundry detergent composition comprising organic surfactant and zeolite builder and having a bulk density of at least 550 g/l, comprising at least two different granular components containing organic surfactant and zeolite builder, and also comprising citric acid as a separate particulate ingredient.

The invention further provides the use of citric acid as a separate admixed ingredient in an amount of from 1 to 10 wt % to improve the dispensing and dissolution properties of a particulate laundry detergent composition comprising organic surfactant and zeolite builder and having a bulk density of at least 550 g/l, which composition comprises at least two different granular components comprising surfactant and zeolite builder.

DETAILED DESCRIPTION OF THE INVENTION

The Postdosed Citric Acid

The citric acid preferably has an average particle size $d_{50}$ within the range of from 200 to 1000 micrometers, more preferably from 250 to 600 micrometers. The quantity $d_{50}$ indicates that 50 wt % of the particles have a diameter smaller than that figure.

Alternatively particle size can be expressed in terms of the Rosin-Rammler average particle size as described in T Allen, "Particle Size Measurement" (3rd Edition, 1981), page 139; and P Rosin and E Rammler, *J. Inst. Fuel,* 7, 29 (1933). The citric acid used in accordance with the present invention preferably has a Rosin-Rammler average particle size d(RR) within the range of from 200 to 1000 micrometers, more preferably from 300 to 700 micrometers.

Particle size may be measured by any suitable method. For the purposes of the present invention particle sizes and distributions were measured using a Helos laser spectrograph.

Preferably, the postdosed citric acid is anhydrous.

The postdosed citric acid is present in an amount of from 1 to 10 wt %, preferably from 1.5 to 5 wt %.

Bulk Density

The composition of the invention has a bulk density of at least 550 g/l, preferably from 600 to 900 g/l, more preferably from 600 to 750 g/l.

The most preferred range of 600 to 750 g/l is lower than the range typical for concentrated powders but higher than that typical of powders prepared by spray-drying and postdosing only. However, compositions according to the invention containing high levels of postdosed inorganic salts may have higher bulk densities.

PREFERRED EMBODIMENT OF THE INVENTION

According to a preferred embodiment of the invention, the composition comprises:

(a) a first granular component containing organic surfactant and zeolite which is non-spray-dried and has a bulk density of from 600 to 1000 g/l, (b) a second granular component containing organic surfactant and zeolite which is spray-dried and has a bulk density of not exceeding 550 g/l, (c) from 1 to 10 wt %, preferably from 1.5 to 5 wt %, of citric acid as a separate particulate ingredient, (d) optionally other detergent ingredients to 100 wt %.

The preferred bulk density for the first granular component is from 650 to 900 g/l.

The preferred bulk density for the second granular component is from 200 to 500 g/l.

The detergent composition may suitably comprise:

(a) from 8 to 60 wt %, preferably from 10 to 40 wt %, of the first granular component, (b) from 5 to 70 wt %, preferably from 40 to 60 wt %, of the second granular component, (c) from 1 to 10 wt %, preferably from 1.5 to 5 wt %, of postdosed citric acid, (d) optionally other postdosed detergent ingredients to 100 wt %.

The first and second granular components are preferably present in a weight ratio of from 0.1:1 to 2:1, preferably from 0.1:1 to 1:1.

In this preferred embodiment of the invention, the weight ratio of the first granular component to the citric acid present as a separate particulate ingredient is preferably within the range of from 5:1 to 20:1, more preferably from 5:1 to 15:1.

The other admixed detergent ingredients may suitably be selected from surfactant granules, bleach ingredients, antifoams, fluorescers, antiredeposition agents, soil release agents, dye transfer inhibiting agents, fabric conditioning agents, enzymes, perfumes, inorganic salts and combinations thereof.

As indicated previously, the use of postdosed citric acid in conjunction with postdosed sodium carbonate to improve dispensing, via the generation of effervescence, is known in the prior art. However, the present invention does not require the presence of postdosed sodium carbonate. The benefits of improved dispensing, dispersion and dissolution are also observed in formulations containing no postdosed sodium carbonate.

The Zeolite Builder

The builder used in the composition of the invention may be any suitable detergent zeolite. Most preferred is zeolite MAP (zeolite P having a silicon to aluminium ratio not exceeding 1.33) as disclosed in EP 384 070B (Crosfield). This is available commercially as Doucil (Trade Mark) A24 from Crosfield Chemicals.

Alternatively, zeolite A (zeolite 4A), available, for example, from Degussa AG as Wessalith (Trade Mark) P, is suitable for use in the compositions of the present invention.

Zeolite MAP is especially suitable for non-tower processing and products. In the preferred embodiment of the invention mentioned above, the first granular component most preferably contains zeolite MAP. The second granular component, which is spray-dried, may contain either zeolite MAP or zeolite A.

The First Granular Component (a)

The first granular component may suitably comprise:

from 10 to 40 wt % of organic non-soap surfactant, from 20 to 50 wt % of zeolite (preferably zeolite MAP), from 5 to 45 wt % (in total) of other salts, and optionally minor ingredients to 100 wt %.

More preferably, the first granular component comprises:

from 10 to 35 wt % of anionic sulphonate or sulphate surfactant, from 5 to 20 wt % of ethoxylated nonionic surfactant, from 30 to 45 wt % of zeolite MAP, from 5 to 30 wt % (in total) of salts, preferably selected from sodium carbonate, sodium citrate and sodium sulphate, and optionally minor ingredients to 100 wt %.

The optional ingredients may be any suitable for incorporation into a non-tower base powder, and may, for example, be selected from fatty acid, fatty acid soap, polycarboxylate polymer, fluorescers and antiredeposition agents.

The first granular component may be prepared by any non-tower process suitable for the production of a zeolite base powder of high bulk density. In a preferred process, solid ingredients are granulated with a liquid binder in a high-speed mixer, and the resulting granules may then be transferred to a moderate-speed mixer. Preferred processes are described and claimed, for example, in EP 340 013A, EP 367 339A, EP 390 251A and EP 420 317A (Unilever). These processes can be used to prepare base powders having bulk densities of, for example, 700 to 1000 g/l.

According to one especially preferred embodiment of the invention, the process described and claimed in WO 00/77147A (Unilever) may be used to prepare a zeolite MAP base powder having a bulk density at the lower end of the range. This process comprises the steps of:

(i) mixing and agglomerating a liquid binder with a solid starting material in a high-speed mixer;

(ii) mixing the material from step (i) in a moderate- or low-speed mixer;

(iii) feeding the material from step (ii) and a liquid binder into a gas fluidisation granulator and further agglomerating, and (iv) optionally, drying and/or cooling.

The Second Granular Component (b)

The second granular component is a spray-dried zeolite base powder and has a bulk density not exceeding 500 g/l, preferably from 200 to 450 g/l, typically from 275 to 425 g/l. It may suitably comprise:

from 10 to 30 wt % of organic non-soap surfactant, from 10 to 50 wt % of zeolite builder, from 10 to 60 wt % of other salts and polymer, and optionally minor ingredients to 100 wt %, all percentages being based on the second granular component.

The second granular component may further comprises sodium silicate, generally incorporated in solution form. The sodium silicate may, for example, be present in an amount of from 0.5 to 15 wt %, preferably from 1 to 10 wt %.

As previously indicated, organic cobuilders such as polycarboxylate polymers may also be present.

More preferably, the second granular component comprises:

from 4 to 25 wt % of anionic sulphonate or sulphate surfactant, from 1 to 15 wt % of ethoxylated nonionic surfactant, from 10 to 45 wt % of zeolite MAP or zeolite A, from 1 to 10 wt % of acrylic or acrylic/maleic polymer, from 0.5 to 10 wt % of sodium silicate, from 15 to 55 wt % of other salts, and optionally minor ingredients to 100 wt %.

The second granular component may contain optional minor ingredients suitable for incorporation into a spray-dried base powder. These may, for example, be selected from fatty acid, fatty acid soap, fluorescers and antiredeposition agents.

The second granular component may be prepared by traditional slurry making and spray-drying methods, well known to the skilled detergent powder formulator.

Where ethoxylated nonionic surfactant is to be present in the second granular component, it may be advantageous if all or a part of this ingredient is admixed with the spray-dried granule instead of incorporated via the slurry.

Detergent Ingredients

As previously indicated, detergent compositions of the invention contain detergent-active compounds and detergency builders, and may optionally contain bleaching components and other active ingredients to enhance performance and properties.

Detergent-active compounds (surfactants) may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch. The preferred detergent-active compounds that can be used are soaps and synthetic non-soap anionic and nonionic compounds. The total amount of surfactant present is suitably within the range of from 5 to 40 wt %.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+ X^-$ wherein the R groups are long or short hydrocarbyl chains, typically alkyl, hydroxyalkyl or ethoxylated alkyl groups, and X is a solubilising cation (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

Detergent compositions suitable for use in most automatic fabric washing machines generally contain anionic non-soap surfactant, or nonionic surfactant, or combinations of the two in any ratio, optionally together with cationic, amphoteric or zwitterionic surfactants, optionally together with soap.

The detergent compositions of the invention also contain one or more detergency builders. The total amount of detergency builder in the compositions will suitably range from 5 to 80 wt %, preferably from 10 to 60 wt %.

The zeolite builders may suitably be present in a total amount of from 5 to 60 wt %, preferably from 10 to 50 wt %. Amounts of from 10 to 45 wt % are especially suitable for particulate (machine) laundry detergent compositions.

The zeolites may be supplemented by other inorganic builders, for example, amorphous aluminosilicates, or layered silicates such as SKS-6 ex Clariant. Sodium carbonate, already listed as a possible ingredient, may also act in part as a builder. Phosphate builders, however, are preferably absent.

The zeolites may be supplemented by organic builders, for example, polycarboxylate polymers such as polyacrylates and acrylic/maleic copolymers; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts.

These lists of builders are not intended to be exhaustive.

Especially preferred organic builders are citrates, suitably used in amounts of from 5 to 30 wt %, preferably from 10 to 25 wt %; and acrylic polymers, more especially acrylic/ maleic copolymers, suitably used in amounts of from 0.5 to 15 wt %, preferably from 1 to 10 wt %. Builders, both inorganic and organic, are preferably present in alkali metal salt, especially sodium salt, form.

Detergent compositions according to the invention may also suitably contain a bleach system. Preferably this will include a peroxy bleach compound, for example, an inorganic persalt or an organic peroxyacid, capable of yielding hydrogen peroxide in aqueous solution. Preferred inorganic persalts are sodium perborate monohydrate and tetrahydrate, and sodium percarbonate, the latter being especially preferred. The sodium percarbonate may have a protective coating against destabilisation by moisture. The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %. Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED).

A bleach stabiliser (heavy metal sequestrant) may also be present. Suitable bleach stabilisers include ethylenediamine tetraacetate (EDTA), diethylenetriamine pentaacetate (DTPA), ethylenediamine disuccinate (EDDS), and the polyphosphonates such as the Dequests (Trade Mark), ethylenediamine tetramethylene phosphonate (EDTMP) and diethylenetriamine pentamethylene phosphate (DETPMP).

Bleach ingredients are postdosed.

The compositions of the invention may contain alkali metal, preferably sodium, carbonate, in order to increase detergency and ease processing. Sodium carbonate may suitably be present in amounts ranging from 1 to 60 wt %, preferably from 2 to 40 wt %. Sodium carbonate may be included in either or both base granule, and/or may be postdosed. As previously indicated, the compositions of the invention may contain no postdosed sodium carbonate.

As previously indicated, sodium silicate may also be present. The amount of sodium silicate may suitably range from 0.1 to 5 wt %. As indicated above, sodium silicate is Dreferably introduced via the second granular component, but may also be present in the first granular component. Sodium silicate may also be postdosed, for example, as granular sodium disilicate, or as sodium carbonate/sodium silicate cogranules, for example, Nabion (Trade Mark) 15 ex Rhodia Chimie.

Powder flow may be improved by the incorporation in one or both granular components of a small amount of a powder structurant. Examples of powder structurants, some of which may play other roles in the formulation as previously indicated, include, for example, fatty acids (or fatty acid soaps), sugars, acrylate or acrylate/maleate polymers, sodium silicate, and dicarboxylic acids (for example, Sokalan (Trade Mark) DCS ex BASF). One preferred powder structurant is fatty acid soap, suitably present in an amount of from 1 to 5 wt %.

Other materials that may be present in detergent compositions of the invention include antiredeposition agents such as cellulosic polymers; soil release agents; anti-dye-transfer agents; fluorescers; inorganic salts such as sodium sulphate; enzymes (proteases, lipases, amylases, cellulases); dyes; coloured speckles; perfumes; and fabric conditioning compounds. These may be included in one or both granular components, if sufficiently robust, or alternatively postdosed in granular form, as is well known to those skilled in the art. This list is not intended to be exhaustive.

EXAMPLES

The invention is further illustrated by the following non-limiting Examples, in which parts and percentages are by weight unless otherwise stated.

Examples denoted by numbers are within the invention, while comparative examples are denoted by letters.

Abbreviations

The following abbreviations are used for ingredients used in the Examples (* denotes Trade Mark):

| | |
|---|---|
| LAS | Linear alkylbenzene sulphonate |
| Nonionic 7EO | $C_{12-15}$ OXO alcohol ethoxylated with an average of 7 moles of ethylene oxide per mole |
| Zeolite MAP | Zeolite MAP (Si:Al ratio about 1) (Doucil* A24 ex Crosfield) |
| Copolymer | Acrylic/maleic copolymer, Na salt (Sokalan* CP5 ex BASF) |
| SCMC | Sodium carboxymethyl cellulose |
| CaEDTMP | Calcium salt of ethylenediamine tetramethylene phosphonic acid (Dequest* 2047 ex Monsanto) |
| TAED | Tetraacetyl ethylenediamine |
| NaHEDP | Sodium salt of 1-hydroxyethane-1,1-diphosphonic acid (Dequest* 2016D ex Monsanto) |
| Carbonate/silicate cogranules | Granules containing 29 wt % sodium silicate, 71 wt % sodium carbonate, Nabion* 15 ex Rhodia Chimie. |

Example 1, Comparative Example A

Non-tower base powder B1 was prepared as follows:

(i) mixing and granulating solid starting materials consisting of zeolite MAP, light soda ash, sodium carboxymethylcellulose (SCMC) with "liquid binder" (LAS acid, nonionic surfactant, fatty acid/soap—see below) in a L dige Recycler* (CB 30) high-speed mixer;

(ii) transferring the material from the Recycler to a L□dige Ploughshare* (KM 300) moderate-speed mixer;

(iii) transferring the material from the Ploughshare to a Vometec* fluid bed operating as a gas fluidisation granulator, adding further "liquid binder" and agglomerating; and (iv) finally drying/cooling the product in the fluid bed.

The "liquid binder" used in steps (i) and (iii) was a structured blend comprising the anionic surfactant, nonionic surfactant and soap components of the base powder. The blend temperature in the loop was controlled by a heat-exchanger. The neutralising agent was a sodium hydroxide solution.

Spray-dried base powder S1 was prepared by a conventional slurry-making and spray-drying process. Of the 7.20 wt % nonionic surfactant, 2 wt % was incorporated via the slurry and the rest sprayed on post-tower.

The formulations and powder properties of the base powders were as shown in the table below.

| | B1 | S1 |
|---|---|---|
| NaLAS | 15.42 | 9.17 |
| Nonionic 7EO | 12.00 | 7.20 |
| Soap (stearic) | 1.74 | 2.23 |
| Zeolite MAP (anhydrous basis) | 39.40 | 23.99 |
| Copolymer (100%) | — | 2.97 |
| Sodium carbonate (light) | 12.93 | 18.30 |
| Sodium silicate (100%) | | 1.94 |
| SCMC (69%) | 0.83 | 0.56 |
| Sodium sulphate slurry grade | — | 26.98 |
| Granular sodium sulphate | 9.68 | — |
| Moisture and salts | 8.00 | 6.66 |
| Total | 100.00 | 100.00 |
| Bulk density (g/l) | 762 | 447 |
| $d_{50}$ [micrometers] | 382 | 402 |
| dRR [micrometers] | 492 | 488 |
| nRR [−] | 1.7 | 1.8 |
| Fines <180 μm [wt %] | 15.4 | 15.5 |
| Coarse >1400 μm [wt %] | 0.2 | 0.1 |

Fully formulated powders were prepared by mixing the base powders above and postdosing the ingredients specified below. Example 1 is within the invention, Comparative Example A is a control containing no postdosed citric acid.

| | Example | |
|---|---|---|
| | A | 1 |
| Ratio B1:S1 [wt %] | 28.25:43.75 | |
| NaLAS | 8.37 | |
| Nonionic 7EO | 6.54 | |
| Soap | 1.47 | |
| Zeolite MAP (100%) | 21.63 | |
| Copolymer | 1.30 | |
| Na carbonate (light) | 11.66 | |
| Na silicate (100%) | 0.85 | |
| SCMC (68%) | 0.48 | |
| Na sulphate slurry grade | 11.80 | |
| Na sulphate granular | 2.73 | |
| Moisture and salts | 5.17 | |
| Subtotal for base powders | 72.00 | |
| Postdosed ingredients | | |
| Na percarbonate | 15.00 | |
| TAED (83%) | 2.60 | |
| Fluorescer adjunct (15%) | 0.80 | |
| CaEDTMP (34%) | 0.72 | |
| Antifoam granule | 1.23 | |
| Soil release polymer (63%) | 0.19 | |
| Cellulase (Carezyme*) | 0.30 | |
| Lipase (Lipolase* 100T) | 0.03 | |
| Protease (Savinase* 12.0 TXT) | 0.44 | |
| Amylase (Termamyl* 60T) | 0.31 | |
| NaHEDP (85%) | 0.40 | |
| Polyvinyl pyrrolidone (95%) | 0.08 | |
| Carbonate/silicate granules | 3.60 | |
| Perfume | 0.30 | |
| Sodium citrate 2aq | 2.00 | — |
| Citric acid | — | 2.00 |
| Total | 100.00 | 100.00 |
| Ratio B1: citric acid | 14.13:1 | — |
| Bulk density [g/l] | 686 | 650 |
| $d_{50}$ [micrometers] | 428 | 430 |
| dRR [micrometers] | 545 | 526 |
| nRR [−] | 1.5 | 1.8 |
| Fines <180 μm [wt %] | 16.0 | 13.4 |
| Coarse >1400 μm [wt %] | 1.8 | 0.1 |

The citric acid used was anhydrous and had the following particle size properties:

| | | |
|---|---|---|
| $d_{50}$ | 413 | micrometers |
| Rosin-Rammler d(RR) | 476 | micrometers |
| Rosin-Rammler N(RR) | 2.7 | |
| Fines (% <180 micrometers) | 3.06 | wt % |
| Oversize (% >1400 micrometers) | 0.03 | wt % |

Measurement of Dispenser Residues

For the purposes of the present invention, dispensing into an automatic washing machine was assessed by means of a standard procedure using a test rig based on the main wash compartment of the dispenser drawer of the Philips (Trade Mark) AWB 126/7 washing machine. This drawer design provides an especially stringent test of dispensing characteristics especially when used under conditions of low temperature, low water pressure and low rate of water flow.

The drawer is of generally cuboidal shape and consists of a main compartment, plus a small front compartment and a separate compartment for fabric conditioner which play no part in the test. In the test, a 100 g dose of powder is placed in a heap at the front end of the main compartment of the drawer, and subjected to a controlled water fill of 5 liters at 10° C. and an inlet pressure of 50 kPa, flowing in over a period of 1 minute. The water enters through 2 mm diameter holes in a plate above the drawer: some water enters the front compartment and therefore does not reach the powder. Powder and water in principle leave the drawer at the rear end which is open.

The flow of water may be ceased at any time, and the powder remaining is then collected and dried at 90° C. to constant weight. The dry weight of powder recovered from the dispenser drawer, in grams, represents the weight percentage of powder not dispensed into the machine at that time (the residue).

Dispensing results after 15, 30 and 60 seconds are shown below. Each result is the average of three measurements.

| | Example | |
|---|---|---|
| Dispenser residue after | A | 1 |
| 60 seconds | 13 | 0 |
| 30 seconds | 20 | 1 |
| 15 seconds | 38 | 23 |

Examples 2 to 5

Further fully formulated detergent compositions were prepared by mixing the non-tower base powder B1 of Example 1 with a spray-dried base powder S2, and postdosing citric acid and further ingredients. All exhibited excellent detergency, powder properties and bleach stability.

The spray-dried base powder S2 had the following formulation:

| | S2 |
|---|---|
| NaLAS | 9.19 |
| Nonionic 7EO | 7.20 |
| Soap (stearic) | 2.79 |
| Zeolite MAP (anhydrous basis) | 20.94 |
| Copolymer (100%) | 2.98 |
| Sodium carbonate (light) | 19.63 |

-continued

| | S2 |
|---|---|
| Sodium silicate (100%) | 2.86 |
| Sodium sulphate slurry grade | 27.67 |
| Moisture and salts | 6.74 |
| Total | 100.00 |
| Bulk density (g/l) | 404 |
| $d_{50}$ [micrometers] | 430 |
| dRR [micrometers] | 519 |
| nRR [–] | 1.9 |
| Fines <180 μm [wt %] | 12.4 |
| Coarse >1400 μm [wt %] | 0.2 |

| | Example | | | |
|---|---|---|---|---|
| | 2 | 3 | 4 | 5 |
| Ratio B1:S2 [wt %] | 10.0:57.1 | 20.0:50.9 | 28.05:44.65 | 42.41:37.59 |
| Bulk density (g/l) | 610 | 621 | 640 | 645 |
| NaLAS | 6.79 | 7.76 | 8.43 | 9.99 |
| Nonionic 7EO | 5.31 | 6.06 | 6.58 | 7.80 |
| Soap | 1.77 | 1.77 | 1.73 | 1.79 |
| Zeolite MAP (100%) | 15.90 | 18.54 | 20.40 | 24.58 |
| Copolymer | 1.70 | 1.52 | 1.33 | 1.12 |
| Na carbonate light | 12.50 | 12.58 | 12.39 | 12.86 |
| Na silicate (100%) | 1.63 | 1.46 | 1.28 | 1.08 |
| SCMC (69%) | 0.08 | 0.17 | 0.23 | 0.35 |
| Na sulphate slurry grade | 15.80 | 14.08 | 12.35 | 10.40 |
| Na sulphate granular | 0.97 | 1.94 | 2.72 | 4.11 |
| Moisture and salts | 4.65 | 5.02 | 5.25 | 5.92 |
| Subtotal for base powders | 67.10 | 70.90 | 72.70 | 80.00 |
| Postdosed ingredients | | | | |
| Na perborate $4H_2O$ | 8.44 | — | — | — |
| Na percarbonate | — | 9.25 | 15.00 | — |
| TAED (83%) | — | 1.30 | 2.60 | — |
| Antifoam granule | 0.98 | 1.13 | 1.23 | 1.46 |
| Fluorescer adjunct (15%) | 0.44 | 0.65 | 0.80 | — |
| PVP adjunct (95%) | — | — | 0.08 | 0.23 |
| Soil release polymer (63%) | — | — | 0.19 | 0.17 |
| CaEDTMP (34%) | 0.38 | 0.54 | 0.61 | 0.76 |
| NaHEDP (85%) | 0.20 | 0.30 | 0.35 | 0.42 |
| Na carbonate dense | 10.00 | 4.25 | — | 4.25 |
| Carbonate/silicate cogranules | | 1.32 | 2.60 | 1.86 |
| Na sulphate granular | 11.03 | 7.53 | 1.16 | 6.57 |
| Protease[1] | 0.16 | 0.18 | — | 0.44 |
| Lipase[2] | — | — | — | 0.03 |
| Amylase[3] | — | — | — | 0.31 |
| Cellulase[4] | — | — | — | 0.20 |
| Citric acid anhydrous | 1.00 | 2.35 | 2.56 | 3.00 |
| Perfume | 0.27 | 0.30 | 0.12 | 0.30 |
| Total | 100.00 | 100.00 | 100.00 | 100.00 |
| B1:citric acid | 10:1 | 8.5:1 | 11:1 | 14:1 |

[1]Savinase* 12.0TXT
[2]Lipolase* 100T
[3]Termamyl* 60T
[4]Carezyme*

We claim:

1. A particulate laundry detergent composition comprising organic surfactant and zeolite builder and having a bulk density of at least 550 g/l, which comprises:

(a) from 8 to 60 wt % of a first granular component, comprising zeolite and organic surfactant which is non-spray-dried and has a bulk density of from 600 to 1000 g/l, the first granular component comprising from 10 to 35 wt % of anionic sulphonate or sulphate surfactant, from 5 to 20 wt % of ethoxylated nonionic surfactant, from 30 to 45 wt % of zeolite MAP, from 5 to 30 wt % (in total) of salt, the percentages being wt % based on the first granular component;

(b) from 5 to 70 wt % of there for second granular component comprising zeolite and organic surfactant which is spray-dried and has a bulk density not exceeding 550 g/l, (c) from 1 to 10 wt % of citric acid as a separate particulate ingredient wherein the citric acid has a particle size d50 within the range of from 200 to 1000 micrometres, preferably from 250 to 600 micrometres, wherein the quantity d50 indicates that 50 wt % of the particles have a diameter smaller than that figure, and (d) other detergent ingredients to 100 wt %.

2. A detergent composition as claimed in claim 1, which comprises from 1.5 to 5 wt %, of citric acid.

3. A detergent composition as claimed in claim 1, wherein the citric acid present as a separate particulate ingredient has a Rosin-Rammler average particle size within the range of from 200 to 1000 micrometres, preferably from 300 to 700 micrometres.

4. A detergent composition as claimed in claim 1, wherein the citric acid present as a separate particulate ingredient is anhydrous.

5. A detergent composition as claimed in claim 1, wherein the weight ratio of the first granular component to the citric acid present as a separate particulate ingredient is within the range of from 5:1 to 20:1, preferably from 5:1 to 15:1.

6. A detergent composition as claimed in claim 1, wherein the first and second granular components are present in a weight ratio of from 0.1:1 to 2:1, preferably from 0.1:1 to 1:1.

7. A detergent composition as claimed in claim 1, wherein the zeolite in the second granular component (b) comprises zeolite MAP or zeolite A.

8. A detergent composition as claimed in claim 1, having a bulk density within the range of from 550 to 900 g/l, preferably from 600 to 800 g/l.

9. A detergent composition as claimed in claim 1, comprising other admixed detergent ingredients selected from surfactant granules, bleach ingredients, antifoams, fluorescers, antiredeposition agents, soil release agents, dye transfer inhibiting agents, fabric conditioning agents, enzymes, perfumes, inorganic salts and combinations thereof.

10. A detergent composition as claimed in claim 1, which contains sodium percarbonate.

11. A detergent composition as claimed in claim 1, which does not contain postdosed sodium carbonate.

* * * * *